US005386940A

United States Patent [19]

Berfield

[11] Patent Number: 5,386,940

[45] Date of Patent: Feb. 7, 1995

[54] MULTIPLE SPRAY PATTERN NOZZLE ASSEMBLY

[75] Inventor: Robert C. Berfield, Jersey Shore, Pa.

[73] Assignee: Shop Vac Corporation, Williamsport, Pa.

[21] Appl. No.: 236,665

[22] Filed: Apr. 29, 1994

Related U.S. Application Data

[63] Continuation of Ser. No. 931,597, Aug. 18, 1992, abandoned.

[51] Int. Cl.[6] ..... B05B 1/16

[52] U.S. Cl. ..... 239/394; 239/600

[58] Field of Search ..... 239/340–349, 239/601, 600

[56] References Cited

U.S. PATENT DOCUMENTS

| | | | |
|---|---|---|---|
| 12,831 | 5/1855 | Roberts | 239/394 |
| 191,199 | 5/1877 | Tomlinson | 239/394 |
| 578,706 | 3/1897 | Adams | 239/394 |
| 659,714 | 10/1900 | Storm | 239/394 |
| 1,093,907 | 4/1914 | Binsbaum | 239/394 |
| 1,157,973 | 10/1915 | Baum | 239/394 |
| 1,199,470 | 9/1916 | Leichtneauer | 239/394 |
| 1,794,964 | 12/1930 | Jenkins | 239/394 |
| 2,132,333 | 9/1937 | Wendell et al. | 299/139 |
| 2,388,093 | 10/1949 | Smith | 239/394 |
| 2,790,680 | 4/1957 | Rosholt | 299/105 |
| 3,675,851 | 7/1972 | Merfeld et al. | 239/318 |
| 3,704,831 | 12/1972 | Clark | 239/394 |
| 4,346,848 | 8/1982 | Malcolm | 239/601 X |
| 4,903,897 | 2/1990 | Hayes | 239/394 |
| 4,976,467 | 12/1990 | Paige | 239/381 |

FOREIGN PATENT DOCUMENTS

| | | | |
|---|---|---|---|
| 286552 | 10/1988 | European Pat. Off. . | |
| 873808 | 2/1960 | France | 239/394 |
| 2206683 | 6/1974 | France . | |
| 2476506 | 8/1981 | France . | |
| 3939568 | 12/1990 | Germany . | |
| 3194163 | 8/1991 | Japan . | |
| 279783 | 12/1951 | Switzerland | 239/394 |
| 627906 | 8/1949 | United Kingdom | 239/394 |
| 1131157 | 10/1968 | United Kingdom . | |
| 1281661 | 7/1972 | United Kingdom . | |

*Primary Examiner*—Andres Kashnikow
*Assistant Examiner*—Kevin Weldon
*Attorney, Agent, or Firm*—Marshall, O'Toole, Gerstein, Murray & Borun

[57] ABSTRACT

A spray nozzle assembly which can provide any of multiple high-pressure spray patterns is durably and affordably built by disposing the spray-forming apertures on a distinctly formed, hard, flat plate fixed to the end of a rotatable barrel with multiple channels. As the barrel rotates within a coupler sleeve, individual channels are sequentially directed into a liquid flow path established by the coupler. Liquid flowing through a selected channel passes through the aperture in the plate associated with that channel, forming a desired spray pattern. A cap that may be mounted over the plate and a portion of the barrel protects against debris becoming lodged between the plate and the barrel, and may have a separate aperture aligned with a separate channel in the barrel to allow production of a low pressure spray pattern.

18 Claims, 6 Drawing Sheets

7

MULTIPLE SPRAY PATTERN NOZZLE ASSEMBLY

This is a continuation of U.S. application Ser. No. 07/931,597, filed Aug. 18, 1992, now abandoned.

TECHNICAL FIELD

This invention relates generally to a liquid-spraying nozzle and more particularly to a nozzle assembly capable of producing different, selectable high-pressure spray patterns.

BACKGROUND ART

Many known multiple pattern spray nozzles have complex structures and are relatively expensive to produce. Some, such as the device disclosed in U.S. Pat. No. 4,976,467 (the disclosure of which is incorporated herein by reference), permit spray pattern selection by rotation of a multi-apertured sprayhead to align one of the apertures into the path of the liquid. Many known spray nozzles utilize molded sprayheads.

To create a high-pressure spray pattern, it may be necessary to use an aperture having a small cross-sectional area, requiring close tolerances. It is difficult to form small apertures with close tolerances in a molded sprayhead.

Another disadvantage of known multiple pattern spray nozzles stems from the substitution of plastic for metal in an effort to reduce costs. When debris clogs a nozzle, many users attempt to remove the debris by inserting a paperclip or knife into the clogged aperture. When the aperture is made of plastic, the insertion of a metal object is likely to damage and deform the aperture, permanently changing the resulting spray pattern.

No known design for a multiple pattern spray nozzle allows the small size and close tolerances necessary for creating high-pressure spray patterns in a durable yet affordable product.

SUMMARY OF THE INVENTION

The invention disclosed and claimed herein overcomes or otherwise obviates the problems presently found in multiple pattern spray nozzles. The invention allows the production of an affordable yet durable multiple pattern spray nozzle with small apertures and close tolerances that is useful for creating high-pressure spray patterns.

Briefly, the benefits of the invention are realized by utilizing a multi-aperture plate that can be stamped, rather than molded, in order to achieve the desired tolerances. The plate can be made of a relatively hard material, such as stainless steel, to substantially protect the apertures against inadvertent damage by a user.

The multi-aperture plate can be mounted in the nozzle by trapping it between a cap and a barrel. The barrel has a separate channel for each of the apertures in the plate. Each of the apertures in the plate is aligned with a different channel in the barrel, and the plate is secured against rotation with respect to the barrel. Accordingly, liquid can be directed through the barrel to any selected one of the apertures. The cap has openings associated with each of the apertures on the plate. The cap openings allow sprays produced by the apertures to pass out of the nozzle. The cap is secured with respect to the plate and the barrel to maintain the desired alignment of the openings with the apertures. The cap may also include a sidewall to protect against debris becoming lodged between the plate and the barrel.

The present assembly can be mounted within a nozzle shroud. A user can then rotate the shroud, which is mechanically connected to the assembly of the cap, plate, and barrel, to select one of the various spray patterns. As the assembly rotates, the channels of the barrel will sequentially align with a channel on a coupler through which liquid is supplied to the barrel. As each channel is aligned with the flow of liquid, the flow is directed through that channel to an associated aperture in the plate. Each aperture produces a different spray pattern as the liquid passes through the cap and out of the nozzle.

The cap and barrel may both be made of plastic, allowing for the production of a relatively inexpensive device.

BRIEF DESCRIPTION OF THE DRAWINGS

Further advantages of the invention will become apparent upon a reading of the following detailed description taken in conjunction with the accompanying drawings, in which.

DESCRIPTION OF THE PREFERRED EMBODIMENTS

Figure 1:
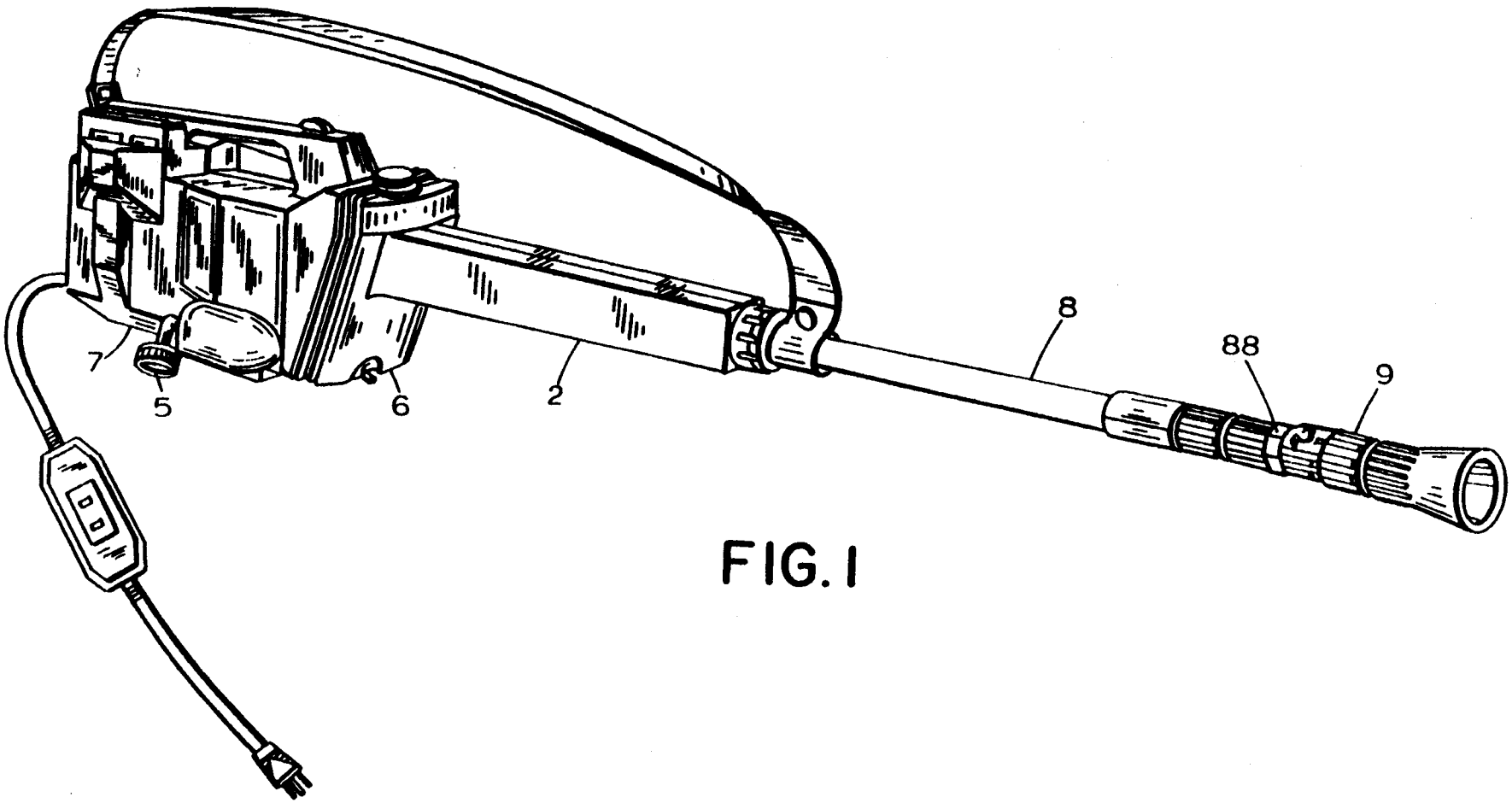
FIG. 1 is a perspective view of a pressure washer in which the present invention may be used.

FIG. 1 shows a hand-held pressure washer 2 that can be used for delivering a high-pressure stream of liquid to clean vehicles, exterior walls, patios, driveways, or the like. To use the washer, a water supply is connected at a hose connection fitting 5. Detergents or other cleaning solutions can be added to a cleaning solution reservoir 6. A motor unit 7 pressurizes the water and delivers a spray of liquid through a nozzle stem 8 and a nozzle shroud 9.

The present invention relates to an assembly that can be used within nozzle shroud 9, or in other types of spray nozzles. In the illustrated embodiment, users can select any of multiple spray patterns by merely rotating shroud 9.

Figure 2:
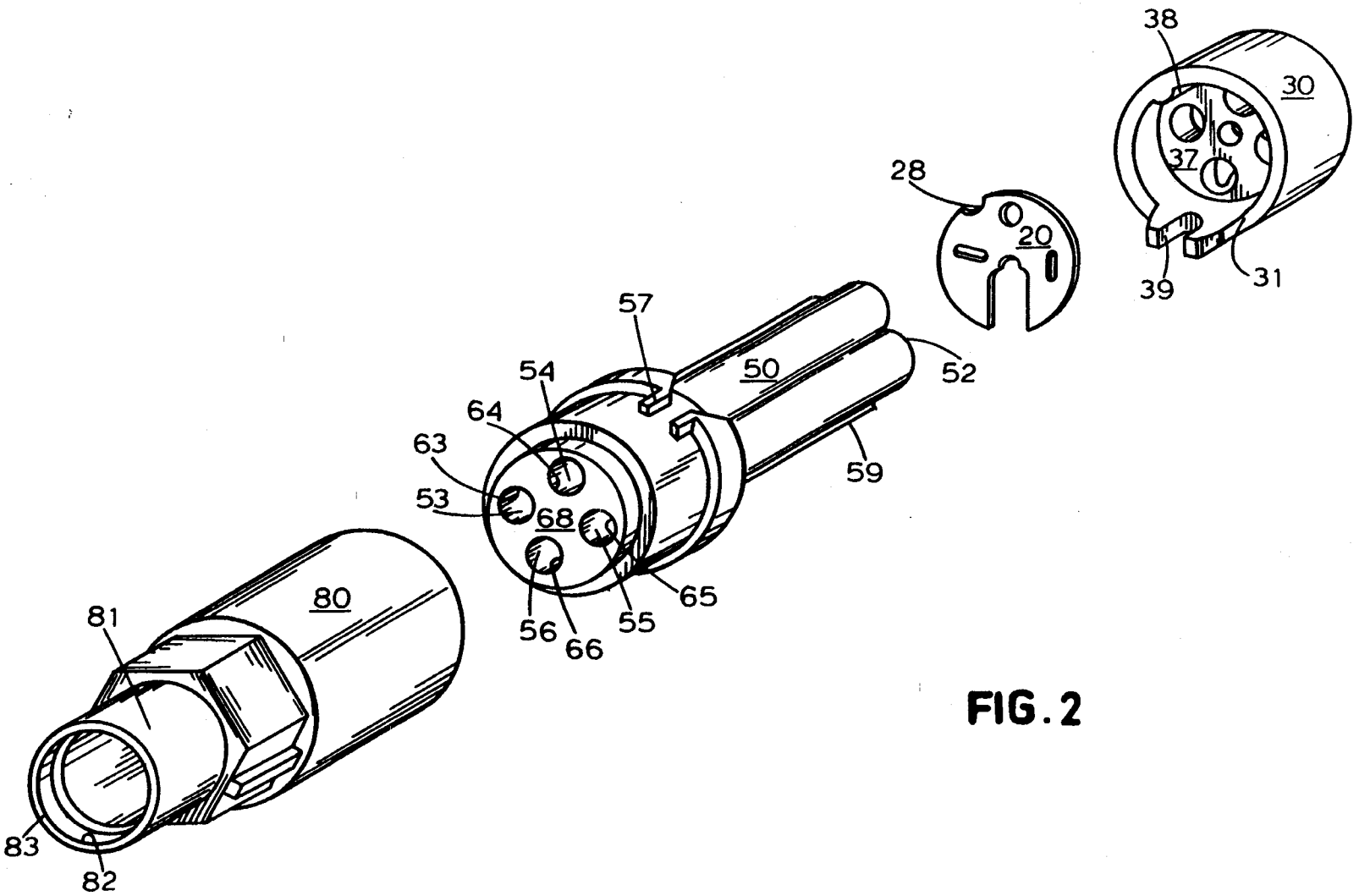
FIG. 2 is an exploded orthographic view of a nozzle assembly in accordance with the present invention.
Figure 3:
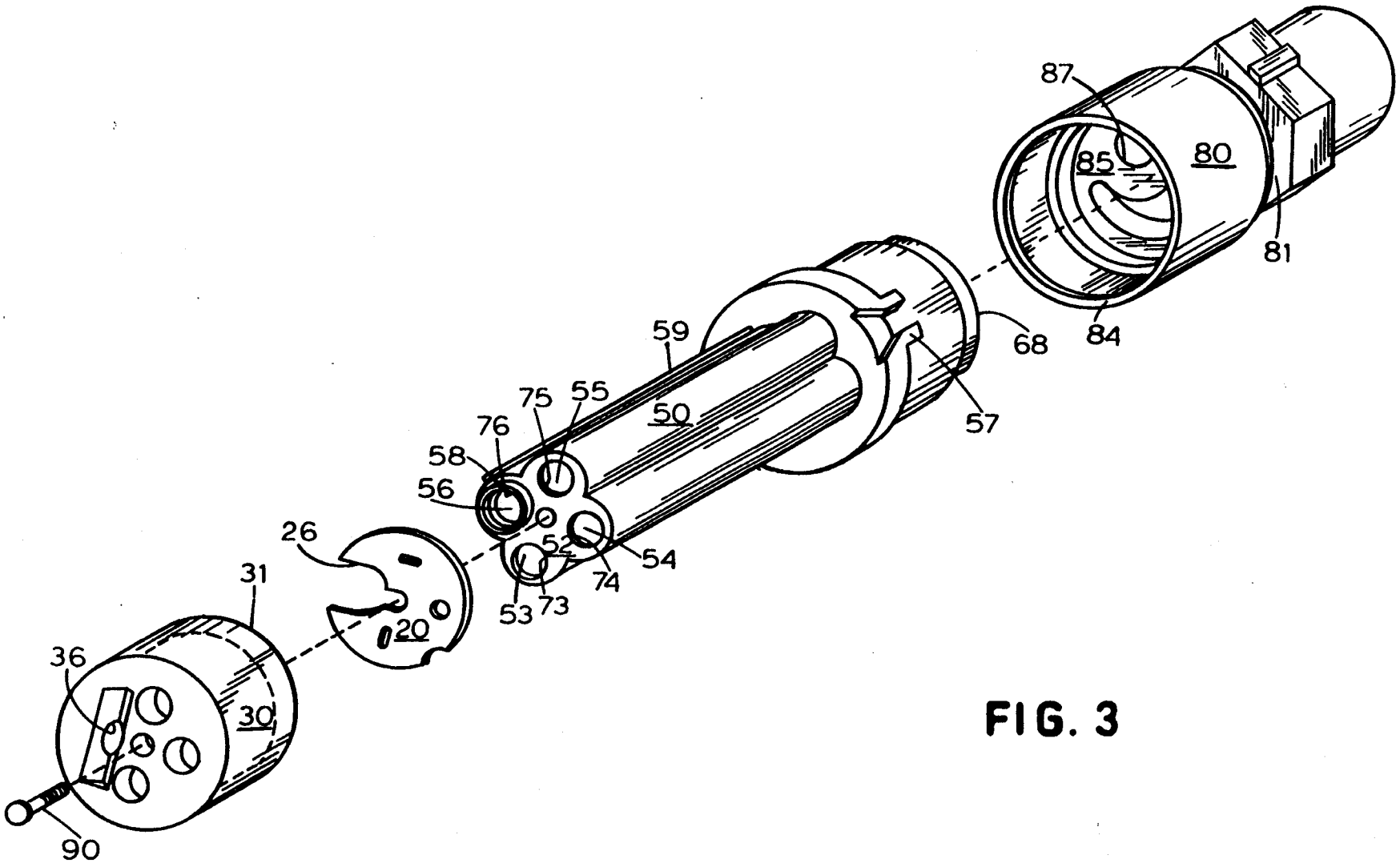
FIG. 3 is another exploded orthographic view of the nozzle assembly of FIG. 2, viewed from another direction.
Figure 4:
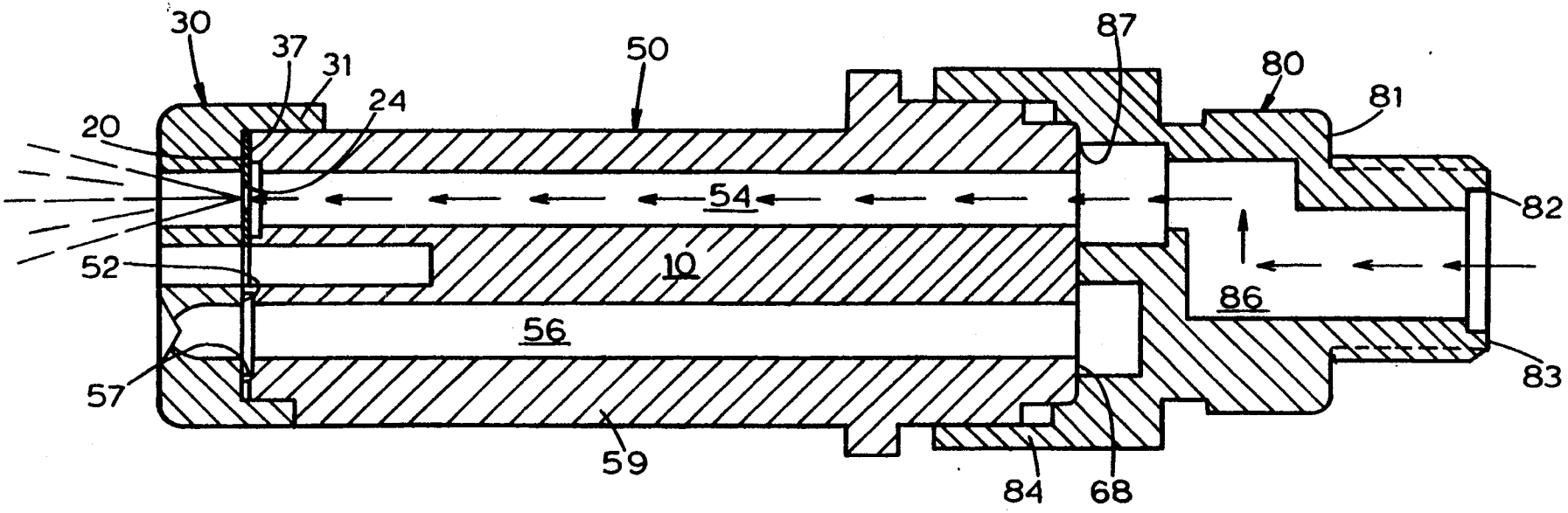
FIG. 4 is a side sectional view of the nozzle assembly.

FIGS. 2, 3, and 4 show a nozzle assembly 10 in accordance with an embodiment of the present invention. As more clearly seen in FIGS. 2 and 3, the assembly includes a multi-aperture plate 20, a cap 30, a barrel 50, and a coupler 80. Barrel 50 is mechanically connected to shroud 9 so that, by rotating the shroud, users direct a flow of liquid entering coupler 80 into any of four channels in barrel 50. The flow meets plate 20, where it passes through an aperture that produces the selected spray pattern. The spray passes through openings in cap 30 and exits the nozzle.

The plate can be any member that has multiple apertures. It is preferable to use a hard plate, meaning a plate that is more resistant to damage from items likely to be used to free debris from the apertures, such as knives or paperclips, than a comparable part conventionally molded out of plastic. Preferably, although not necessarily, the plate is harder than the cap and the barrel. It is also preferable that the plate be flat and constructed of a material that can be stamped with apertures as small as 0.002 square inches with tolerances within 0.0005 inches.

Figure 5:
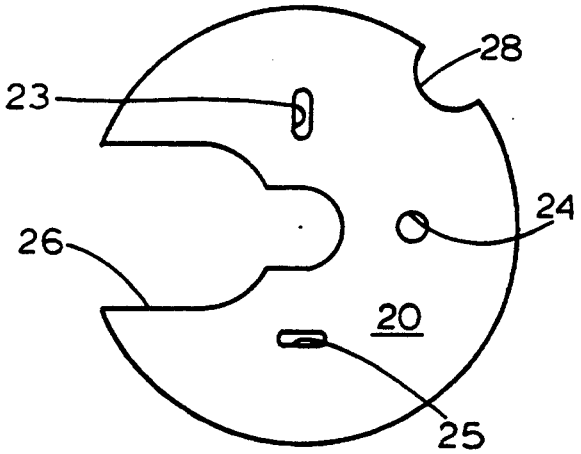
FIG. 5 is a front view of a multi-aperture plate in accordance with an embodiment of the present invention.
Figure 6:
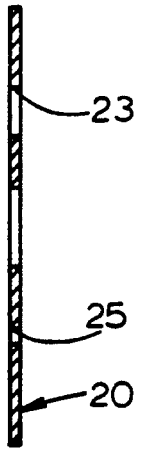
FIG. 6 is a side view of the plate of FIG. 5.

In the illustrated embodiment, plate 20, as seen in FIGS. 5 and 6, is made of stainless steel. The plate is approximately 0.71 inches in diameter and approximately 0.02 inches in thickness. It has been stamped in a die to produce three apertures 23, 24, and 25, each having a different cross-sectional configuration and each designed to produce a different, specific high-pressure spray pattern. Each of these apertures has a cross-sectional area of about 0.002 square inches. Each aperture is centered about 0.18 inches from the central axis of the plate. Apertures 23 and 25 are each approximately 0.07 inches by 0.03 inches. Aperture 24 has a circular cross-section with a diameter of approximately 0.05 inches. The apertures are spaced at 90° increments across the face of plate 20. An indentation 26 is also formed in the plate at 90° relative to apertures 23 and 25 and at 180° relative to aperture 24.

The cap can be any member that secures the plate to the barrel while allowing a spray to exit the apertures. It is preferable that the cap have a sidewall that helps to keep debris from lodging between the plate and the barrel.

Figure 7:
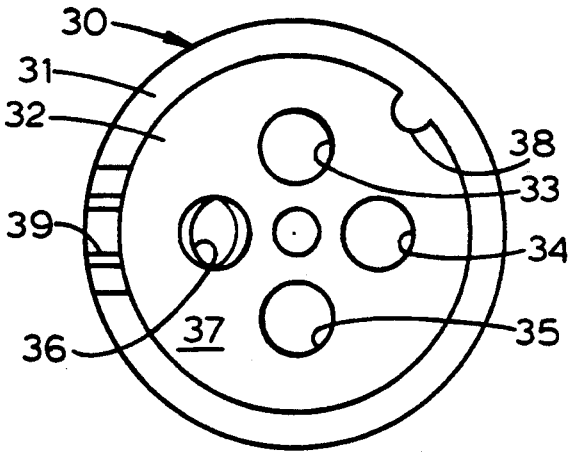
FIG. 7 is an end view of a cap for use in connection with the plate of FIG. 5.
Figure 8:
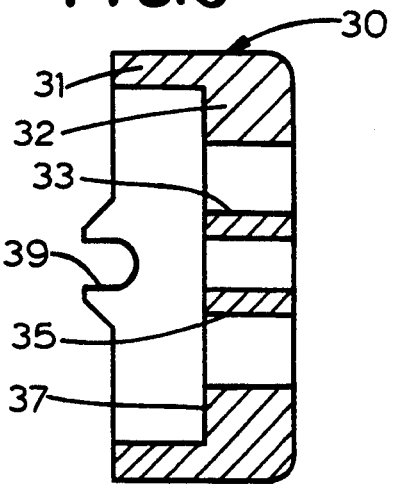
FIG. 8 is a side sectional view of the cap of FIG. 7, taken through section 8—8.
Figure 9:
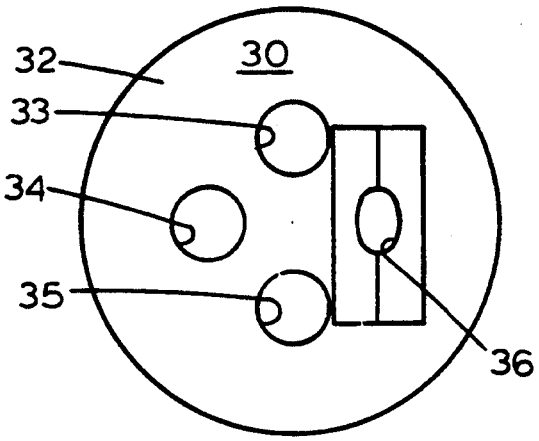
FIG. 9 is an opposite end view of the cap of FIG. 7.

In the illustrated embodiment, as shown in FIGS. 7, 8, and 9, cap 30 is cylindrical, and has a peripheral sidewall 31 projecting from a base 32. Cap 30 has a diameter of approximately 0.87 inches. As seen in FIG. 8, base 32 is approximately 0.19 inches thick and sidewall 31 projects about 0.20 inches from a cap inner face 37. The cap is molded from plastic or comparable material to have three openings 33, 34, and 35, and an aperture 36, seen in FIGS. 7 and 9, all arranged on base 32. Openings 33, 34, and 35 are associated with apertures 23, 24, and 25, respectively. Each of these openings is circular and arranged to allow a spray to exit the aperture associated with the opening. In the illustrated embodiment, the openings are all centered approximately 0.18 inches from the centerline of cap 30 and have a diameter of approximately 0.16 inches.

In the illustrated embodiment, aperture 36 in cap 30 is associated with indentation 26 in plate 20 and is designed, as well-known in the art, to produce a relatively low-pressure spray pattern for which a small aperture with close tolerances is not necessary. At cap inner face 37 of the base, aperture 36 has a diameter of approximately 0.16 inches and a relatively large cross-sectional area of about 0.02 square inches.

As shown, the diameter of the opening within sidewall 31 is approximately 0.73 inches, or just slightly wider than the diameter of plate 20. As seen in FIG. 4, plate 20 rests against cap inner face 37 within sidewall 31. As seen in FIG. 2, proper alignment of plate 20 within cap 30 is established and maintained by the seating of a tongue 38 on the inside of the sidewall within a slot 28 on the edge of the plate. In order to facilitate initial alignment of the plate within the cap while adequately restricting relative rotation of the parts, tongue 38 is molded with a radius of approximately 0.02 inches while slot 28 is stamped with a radius of approximately 0.06 inches.

The barrel can be any member having multiple channels that can be rotated into a flow of liquid.

In the illustrated embodiment, as seen in FIGS. 2 and 3, barrel 50 is approximately 2.31 inches long and has a width of approximately 0.71 inches at a plate end 52. This width allows portions of the barrel to fit within sidewall 31 of cap 30. Barrel 50 is molded from a suitable plastic material with four channels 53, 54, 55, and 56 extending longitudinally throughout the barrel from coupler openings 63, 64, 65, and 66 at a cylindrical end 68 of the barrel to barrel outlets 73, 74, 75, 76 at plate end 52. Each channel is centered approximately 0.18 inches from the central axis of the barrel and is arranged at 90° relative to adjacent channels.

As seen in FIG. 2, plate end 52 of the barrel rests against plate 20 within sidewall 31 of cap 30. Channels 53, 54, and 55 are aligned with apertures 23, 24, and 25 of the plate. In order to assure adequate flow of liquid to the apertures to provide the desired spray patterns, even if the parts are not perfectly aligned, each of channels 53, 54, and 55 has a significantly greater cross-sectional area than its associated aperture. In the illustrated embodiment, each of channels 53, 54, and 55 has a diameter of approximately 0.16 inches and opens to a wider diameter of approximately 0.20 inches at a depth of about 0.03 inches from plate end 52.

Figure 10:
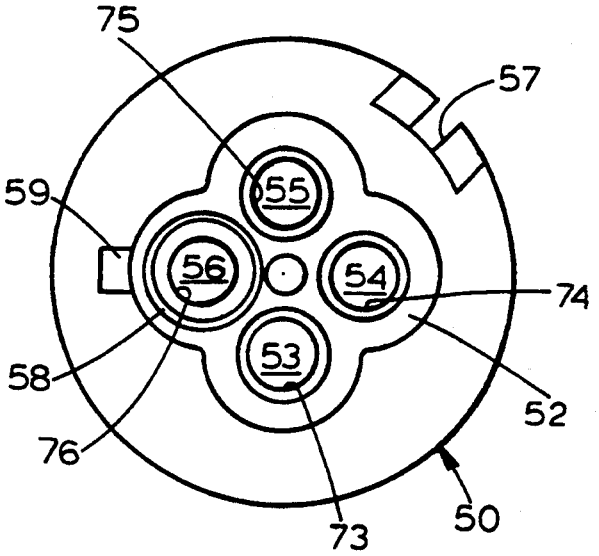
FIG. 10 is an end view of a barrel for use in connection with the plate of FIG. 5.

In this embodiment, as seen in FIGS. 2, 3, and 10, barrel 50 includes a guide stop 57 in the form of an outward projection on the barrel. This guide stop provides the mechanical connection between the barrel and a key inside shroud 9 (FIG. 1). As well known in the art, such a connection causes the barrel to rotate as the shroud is rotated.

As illustrated in FIG. 3, channel 56 in barrel 50 is aligned with indentation 26 on plate 20, and is associated with aperture 36 in cap 30. A collar 58 projects axially from the barrel around channel 56 near barrel outlet 76. This collar extends a distance corresponding to the thickness of plate 20, and fits within indentation 26 to rest against cap inner face 37, seen in FIGS. 2 and 4. While the diameter of channel 56 is designed to be the same as the diameter of aperture 36 at the cap inner face, channel 56 opens to a wider diameter of approximately 0.23 inches at a depth of about 0.03 inches from plate end 52. This assures adequate flow of liquid to aperture 36 even if the parts are not perfectly aligned.

Figure 11:
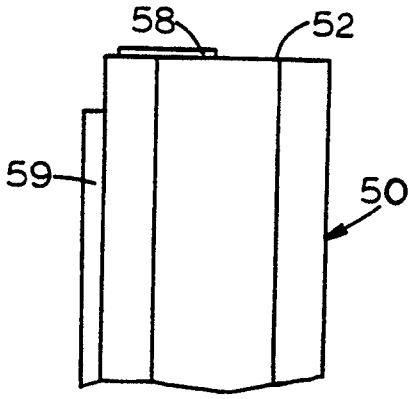
FIG. 11 is a partial side view of the barrel of FIG. 10.
Figure 12:
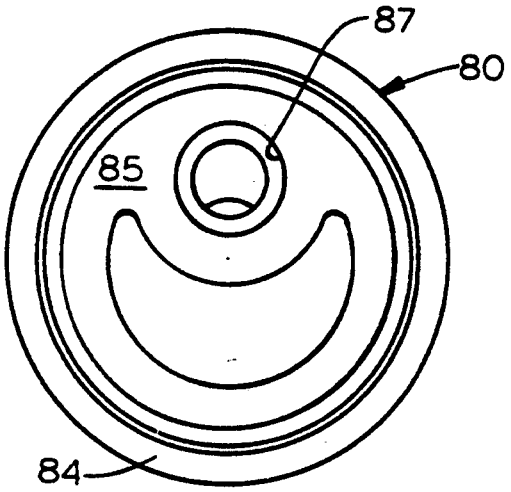
FIG. 12 is an end view of a coupler for use in connection with the barrel of FIGS. 10 and 11.

As illustrated in FIG. 3, cap 30, plate 20, and barrel 50 can be secured together in any conventional way, such as by a plug or screw 90 mounted along the central axis of all three pieces. In this embodiment, the rotational alignment of the barrel with the plate and the cap is maintained in two ways. First, as seen in FIG. 3, collar 58 cooperates with indentation 26 on the plate to restrict relative rotation. To this end, the diameter of the collar is approximately 0.26 inches while the maximum width of the indentation is approximately 0.27 inches. Second, a rib 59 on the barrel, best seen in FIGS. 10 and 11, cooperates with a notch 39 in sidewall 31 of the cap, best seen in FIG. 2. Rib 59 extends longitudinally along the barrel, projecting outwardly approximately 0.12 inches. The rib terminates approximately 0.16 inches from plate end 52 of the barrel, so that it does not interfere with sidewall 31 covering both the peripheral edges of the plate and portions of the plate end of the barrel. Accordingly, cap 30 protects against debris becoming lodged between the barrel and the plate. For convenience, notch 39 in the sidewall is approximately 0.11 inches wide, while rib 59 is 0.10 inches wide.

The coupler can be any member that cooperates with the barrel to direct a flow of liquid into a selected one of multiple channels.

In the illustrated embodiment, as seen in FIGS. 2, 3, 12, and 13, coupler 80 has a coupler base 81 that includes a liquid inlet 82 on an inlet side 83 of the coupler base. Liquid inlet 82 has an interior diameter of approximately 0.38 inches. The portion of the coupler base adjacent the liquid inlet may be threaded for ease of connection to nozzle stem 8, seen in FIG. 1.

As best seen in FIG. 3, coupler 80 has a sleeve 84 extending longitudinally from the periphery of a barrel side 85 of coupler base 81. As seen in FIG. 4, a coupler channel 86 extends from liquid inlet 82 to an interior coupler opening 87 on the barrel side of the coupler base. Interior coupler opening 87 is centered approximately 0.18 inches from the central axis of sleeve 84 and has a diameter of approximately 0.19 inches.

Figure 13:
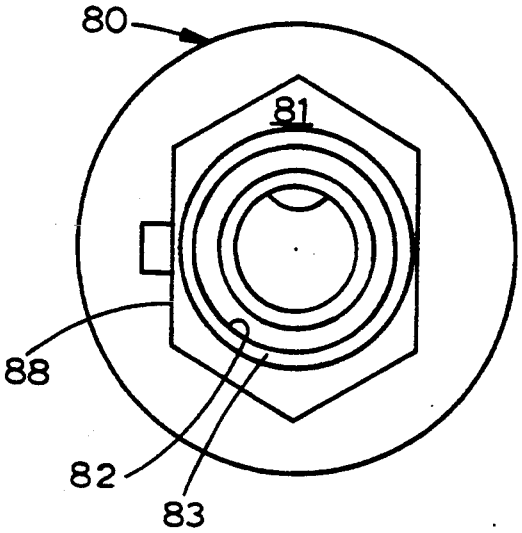
FIG. 13 is an opposite end view of the coupler of FIG. 12.

In the illustrated embodiment, coupler 80 includes a hexnut portion 88, seen in FIGS. 1 and 13, that provides a ready means for attaching the coupler to nozzle stem 8.

As seen in FIG. 4, cylindrical end 68 of barrel 50 is mounted for rotation within sleeve 84. The sleeve extends over approximately 0.55 inches of the barrel. The cylindrical end of the barrel, having a diameter of approximately 0.880 inches, fits snugly within the sleeve, which has an interior diameter of approximately 0.881 inches. Coupler openings 63, 64, 65, and 66 on the barrel, seen in FIG. 2, are all arranged so that, when the barrel and the coupler are rotated with respect to each other, each coupler opening is aligned, in its turn, with interior coupler opening 87. In this way, liquid flowing through coupler channel 86 can be directed to any one of the coupler openings and, accordingly, into any selected one of channels 53, 54, 55, or 56. In accordance with the invention, liquid flowing from the coupler into a selected channel in the barrel will flow to the aperture associated with the channel and be formed into a desired spray pattern.

The illustrated embodiment of the invention can be used to form any of three relatively high-pressure spray patterns or a relatively low-pressure spray pattern. The high-pressure spray patterns are produced by apertures 23, 24, and 25 on plate 20, best seen in FIG. 5, all of which have relatively small cross-sectional configurations. The low-pressure spray pattern is formed by aperture 36 on cap 30, seen in FIGS. 4, 7, and 9, which has a relatively large cross-sectional configuration.

A high-pressure spray pattern can thus be selected by rotating shroud 9 (FIG. 1) so that barrel 50 (FIGS. 2, 3, and 4) rotates within sleeve 84 until one of channels 53, 54, and 55 moves into fluid communication with interior coupler opening 87. Liquid flowing into the assembly will then be directed through the channel to one of apertures 23, 24, and 25 on plate 20. The relatively small cross-sectional configuration of the aperture will cause the formation of the desired high-pressure spray pattern.

The illustrated assembly allows selection of a relatively low-pressure spray pattern by rotating the shroud until channel 56 is aligned with the interior coupler opening. Liquid flowing into the assembly will then be directed to aperture 36 on cap 30. The relatively large cross-sectional configuration of aperture 36 leads to the formation of a relatively low-pressure spray pattern. Aperture 36 can be molded in relatively soft cap 30 rather than stamped in relatively hard plate 20 because it is an aperture with a relatively large cross-sectional configuration and close tolerances are not as important in such an aperture.

While one or more embodiments of the invention have been illustrated and described in detail, it should be understood that modifications and variations of these embodiments may be effected without departing from the spirit of the invention and the scope of the following claims.

I claim:

1. A spray nozzle assembly comprising:

a barrel that has multiple channels through which liquid can flow and that can be moved with respect to a liquid flow so that the flow can be directed into a selected one of the channels; and a distinctly formed, hard, flat, plate that is permanently fixed to a plate end of the barrel by rotational alignment securing means and a fastener and that has a first aperture aligned with one of the channels and configured to produce a spray of a desired pattern, and a second aperture aligned with another of the channels.

2. The nozzle assembly of claim 1, in which the plate is made from a material that can be stamped in a die to tolerances of within 0.0005 inches.

3. The nozzle assembly of claim 1, in which the first aperture has a cross-sectional area of about 0.002 square inches.

4. The nozzle assembly of claim 1, in which the plate is made of a material that is at least as resistant to deformation as stainless steel.

5. The nozzle assembly of claim 1, in which the plate is made of stainless steel.

6. The nozzle assembly of claim 5, in which:

the barrel has four channels spaced around a central axis of the barrel; and the plate has a separate aperture for each of three of the channels.

7. The nozzle assembly of claim 5 that also comprises a coupler that has:

a sleeve that extends axially from a peripheral portion of a barrel side of a coupler body; and a coupler channel that passes from an inlet side of the coupler body to an opening that is located on the barrel side of the coupler body and is spaced at a distance from a central axis of the sleeve.

8. The nozzle assembly of claim 5 that also comprises a cap that has:

a sidewall that covers both an outer edge of the plate and a portion of the plate end of the barrel; and an opening that is in fluid communication with the first aperture and has a cross-sectional area that is larger than the cross-sectional area of the first aperture.

9. The nozzle assembly of claim 8, in which a collar on the barrel projects longitudinally around yet another channel, fits within an indentation in the plate, and is aligned with an aperture on the cap.

10. A spray nozzle assembly comprising:

a coupler with a liquid inlet on an inlet side of a coupler base, a cylindrical sleeve projecting longitudinally from the periphery of a barrel side of the coupler base, and a coupler channel extending from the liquid inlet to an interior coupler opening located on the barrel side and spaced at a distance from a central axis of the sleeve;

a barrel with a cylindrical end that is configured to rotate within the sleeve, first and second coupler openings spaced on the cylindrical end so that each may be brought into fluid communication with the coupler channel, and first and second channels extending from the first and second coupler openings, respectively, to first and second barrel outlets on a plate end of the barrel;

a plate on the plate end of the barrel, with a first aperture in fluid communication with the first barrel outlet and a second aperture in fluid communication with the second barrel outlet; and a distinctly formed cap with a sidewall that covers both an outer edge of the plate and a portion of the plate end of the barrel, a first opening in fluid communication with the first aperture, and a second opening in fluid communication with the second aperture.

11. The nozzle assembly of claim 10, in which the plate is made of stainless steel.

12. The nozzle assembly of claim 10, in which a collar on the barrel projects longitudinally around a third channel in the cylinder, fits within a notch in the plate, and is in fluid communication with an aperture on the cap.

13. A spray nozzle assembly comprising:

a first member having a channel therethrough adapted to establish a flow along a liquid flow path; and a flat second member that is harder than the first member, the second member being permanently fixed to a rotatable member by rotational alignment securing means and a fastener and having first and second cylindrical apertures capable of being selectively and exclusively moved into the liquid flow path without disassembly of the assembly, the first cylindrical aperture having a first cross-sectional configuration capable of forming a first spray pattern when the aperture is disposed in the liquid flow path and the second cylindrical aperture having a second cross-sectional configuration that is different than the first cross-sectional configuration and is capable of forming a second spray pattern that is different than the first spray pattern when the second aperture is disposed in the liquid flow path.

14. The nozzle assembly of claim 13, further comprising:

a distinct cap adjacent the second member, moveable therewith, and having an opening aligned with one of the apertures and adapted to permit a spray therethrough.

15. The nozzle assembly of claim 1, in which the second aperture is configured to produce a spray of a second desired pattern.

16. The nozzle assembly of claim 10, in which the plate is a distinctly formed element.

17. The nozzle assembly of claim 13, in which the rotatable member is rotatable about an axis parallel to the liquid flow path.

18. A spray nozzle assembly comprising:

a first member having a channel therethrough adapted to establish a flow along a liquid flow path;

a flat second member that is harder than the first member, the second member having a notch and first and second apertures capable of being moved into the liquid flow path, the first aperture having a first cross-sectional configuration capable of forming a first spray pattern when the aperture is disposed in the liquid flow path and the second aperture having a second cross-sectional configuration that is different than the first cross-sectional configuration and is capable of forming a second spray pattern that is different than the first spray pattern when the second aperture is disposed in the liquid flow path; and a collar, accommodated by the notch, which can direct the flow of liquid to a third aperture on a separate cap.

* * * * *

UNITED STATES PATENT AND TRADEMARK OFFICE

CERTIFICATE OF CORRECTION

PATENT NO. : 5,386,940

DATED : February 7, 1995

INVENTOR(S) : Robert C. Berfield

It is certified that error appears in the above-indentified patent and that said Letters Patent is hereby corrected as shown below:

On the title page, after item [56] the following should be inserted in the Foreign Patent Documents --20,251/24 10/1924 Australia--.

Signed and Sealed this

Twentieth Day of June, 1995

*Attest:*

Bruce Lehman

BRUCE LEHMAN

*Attesting Officer*

*Commissioner of Patents and Trademarks*